United States Patent [19]

Niemi

[11] 4,133,038

[45] Jan. 2, 1979

[54] METHOD OF CONSTRUCTING A CONTINUOUSLY OPERABLE FLOTATION CONCENTRATION PLANT

[76] Inventor: Antti Niemi, Yrgö Liipolantie 5, Kauniainen, Finland

[21] Appl. No.: 858,353

[22] Filed: Dec. 7, 1977

Related U.S. Application Data

[63] Continuation-in-part of Ser. No. 799,940, May 24, 1977, abandoned, which is a continuation of Ser. No. 689,926, May 25, 1976, abandoned.

[30] Foreign Application Priority Data

May 26, 1975 [FI] Finland ..... 751525

[51] Int. Cl.[2] ..... B03B 9/00; B03B 13/00

[52] U.S. Cl. ..... 364/502; 209/166

[58] Field of Search ..... 369/502; 209/162, 164, 209/166, 167, 168

[56] References Cited

U.S. PATENT DOCUMENTS

| | | | |
|---|---|---|---|
| 3,207,304 | 9/1965 | Thom | 209/167 |
| 3,551,897 | 12/1970 | Cooper | 364/502 |
| 3,735,931 | 5/1973 | Weston | 209/166 |
| 3,901,450 | 8/1975 | Weston | 209/166 |
| 3,976,251 | 8/1976 | Gambopoulos et al. | 209/166 |
| 4,011,072 | 3/1977 | Holman et al. | 209/166 |
| 4,022,686 | 5/1977 | Arakatsu et al. | 209/166 |

*Primary Examiner*—Felix D. Gruber
*Attorney, Agent, or Firm*—Toren, McGeady and Stanger

[57] ABSTRACT

A new method of effecting flotation of mineral grains on a laboratory scale is provided, wherein a mineral sample of uniform grain size and uniform mineral composition is conditioned to produce a definite degree of adsorption and then subjected to flotation. The floating mineral grains are separated at time intervals to let the flotation rate coefficient to be determined. On the basis of this procedure a method of constructing a continuously operable flotation concentration plant was developed. This method comprises repeating the laboratory scale flotation a plurality of times using a different degree of adsoprtion in each case, which enables the relationship between the degree of adsorption and the flotation rate coefficient to be determined. Thereafter the same procedure is repeated so that all the different grain sizes and mineral compositions present in the material to be handled are covered. The resulting relationships are then used in a simulation procedure, where the distribution of the material in a continuous flotation concentration process is determined, and finally the concentration plant is constructed in accordance with this determination. Furthermore, a similar scheme may be used to control the distribution of the material in a existing flotation concentration plant.

7 Claims, 6 Drawing Figures

METHOD OF CONSTRUCTING A CONTINUOUSLY OPERABLE FLOTATION CONCENTRATION PLANT

CROSS REFERENCE TO RELATED APPLICATIONS

This application is a Continuation-in-Part of application Ser. No. 799,940, filed on May 24, 1977 now abandoned, which, in turn, was a continuation of application Ser. No. 689,926, filed on May 25, 1976, now abandoned, the contents of which are incorporated herein by reference.

BACKGROUND OF THE INVENTION

The object of froth flotation is to separate grains of different minerals from each other. The process is based on various properties of the free mineral surfaces. These properties can be affected by suitable treatment, but since normally all grains undergo the same steps of preparation, the separation is always based on the inherent physical and chemical characteristics of the mineral surfaces. In the traditional constructing of flotation circuits these characteristics are not analysed nor consistently utilized. Contrary to this, the new method to be described aims to determine certain parameters and variables describing the fundamental characteristics of different minerals and to establish the design, construction and control of flotation circuits on such information.

As for the factors determining the flotation behaviour of a mineral, the flotation rate coefficient k is commonly employed to describe the speed of flotation. Its value is different for different minerals; in this connection the individual mineral is understood to be specific with regard not only to mineral composition but also to grain size, among other things. Grains which are equivalent also in this respect will hereinbelow be considered to belong to the same grain type. Even grains of the same type may have different coefficients, if e.g. they have been subjected to treatment by chemical conditioning of different degrees.

In the article "A study of dynamic control properties of industrial flotation processes" by A. Niemi in Acta Polyt. Scand. Chem., No. 48 2nd ed., Helsinki 1972 the flotation phenomenon has been shown to be a first-order irreversible kinetic process.

$$\frac{dC}{dt} = -kC \tag{1}$$

C = concentration of the grain type in the flotation suspension k = flotation rate coefficient The significance of the flotation rate coefficient in view of the operation of the flotation circuit is presently understood, and by means of this coefficient the operation of circuits may be analysed both in the steady state, as shown by T. Imaizumi and T. Inoue in Proc. VI Int. Min. Proc. Congr., Cannes 1963; Pergamon 1965, p. 581, and in a dynamically changing state (Niemi, Loc. Cit.). The dependence of the coefficient on the basic properties of the mineral surface and on parameters characterizing the conditioning has, however, not been clarified in a manner which would enable it to be utilized consistently in such constructing work which covers both the process of flotation and the preceding conditioning steps.

The value of the rate coefficient of each grain type is best determined under known standard conditions, e.g. in an elected flotation cell of laboratory type with constant speed of rotation of the impeller, constant air flow, etc. For determination of the coefficient the floating material is gathered and its amount is determined at predetermined intervals (Imaizumi & Inoue, Loc. Cit.).

The degree of conditioning of a grain can be expressed by the relative adsorption Γ of the collecting agent, which in its turn is equivalent to the amount of adsorbed collector in proportion to the amount of chemical corresponding to full monomolecular coating. The dependence of the coefficient K on Γ has not been determined. However, when a system comprising conditioning and flotation is constructed, the determination and understanding of this relationship is of central importance.

The adsorption of the collecting agent on the surface of a mineral grain is a kinetic process which can be described by the following differential equation (Niemi, Loc. Cit.):

$$\frac{d\Gamma}{dt} X(1 - \Gamma)C_x \tag{2}$$

X = adsorption rate coefficient $C_x$ = concentration of collecting agent in the liquid phase This equation is valid for each mineral type. In view of industrial conditioning, it is important to known the value of the adsorption rate coefficient X for each type of grain.

The adsorption rate coefficient X is a parameter characterizing the inherent surface-physics properties of the grain; and the variable Γ, and furthermore k, depends essentially on its value.

However, the value also depends on other factors, which are: the pH of the surrounding liquid phase, and various chemicals dissolved therein. The process of adsorption is also intentionally acted upon in practice in order to produce flotation of the desired kind. In such case, X has to be determined under the desired chemical conditions. It is often expedient to determine its value by a series of experiments as a function of the concentrations of various chemicals and of the pH value.

In a full scale industrial process the conditioners and flotation cells are of the continuous flow type, differing from laboratory apparatus. The construction of an industrial flotation plant is usually based on relationships which have been determined in the laboratory or on a pilot plant scale, and which usually are presented in the form of families of curves or equivalent. The parameters mentioned above and their interrelationships or their dependence on different variables determined in the laboratory are then not utilized.

SUMMARY OF THE INVENTION

The principal object of this invention is to provide a new method of constructing a continuously operable flotation concentration plant. The method is based on flotations of mineral grains on a laboratory scale and this flotating in itself constitutes a further object of the invention.

The materials for the laboratory-scale flotations are provided by samples of uniform grain size and uniform mineral composition representing the ore that will be handled in the concentration plant. A sample is conditioned with a strongly adsorbable collecting agent used in an amount which is a fraction of the amount sufficient to create a monomolecular layer on the grains. During the conditioning the collecting agent is thus completely adsorbed and the degree of adsorption attains a value that corresponds to said fraction. The conditioned mineral grains are then subjected to flotation and the floating mineral grains are separated at time intervals to enable the flotation rate coefficient to be determined.

In view of constructing a flotation concentration plant the procedure as set forth above is first repeated a plurality of times using similar mineral samples but a different degree of adsorption in each case. By that means the relationship between the degree of adsorption and the flotation rate coefficient can be determined. Thereafter the same procedure is repeated in a similar manner for the other samples so that finally said relationships for all the grain sizes of the different mineral compositions of the ore have been obtained. These relationships are then used to determine, by means of a predetermined simulation procedure, the distribution of the ore mineral to be handled in the continuous flotation concentration process. In the flotation concentration plant the material is continuously distributed into concentrates, wastes and middlings and the plant is thus constructed to provide the means for carrying out this distribution in accordance with the previous determination.

A still further object of the invention is to provide a method of controlling a continuously operable flotation concentration plant. This method comprises determining the relationships between the degrees of adsorption and the flotation rate coefficients as well as determining the distribution of the material in the continuous process as described above. The concentration plant is then controlled by adjusting the feeds of ore, water, conditioning chemicals and air to distribute the material into concentrates, wastes and middlings in accordance with the determination.

In comparison with the prior art the present method allows a greater consistency with respect to the parameters of the process and their interrelationships, and it is thereby possible to base the construction of an industrial system more clearly than heretofore on the inherent surface-physics properties of the minerals and on the quantities characterizing them and the chemical preparation and the mode of control and operation of the process apparatus.

As shown later in the detailed description, in the study of flotation circuits Γ may be used advantageously as independent variable instead of k when the conditioning and flotation stages are simultaneously constructed or controlled. The methodology of constructing is presently particularly deficient when the material is returned from the flotation circuit to the conditioning step. By means of the method to be presented such recirculation can be consistently taken into account during the construction, or in controlling of the process.

The method to be presented is essentially based on simulation by computer, after the parameters and relationships mentioned above have been determined. The requisite programmes prove to be comparatively fast and it is therefore possible to clarify the flotation of a given mineral within short time for a great number of different circuits and values of the control variables. The result thereby obtained gives the flow of the different mineral types, and further of the total of a metal-bearing mineral which is of interest, to the flotation residue, to concentrate and to other points of interest, as well as the dependence of these flows on various factors. An even more essential result is the clarification of the separability of various metal-bearing minerals and, the attainment of the best, or the desired, selectivity. The industrial flotation plant can then be designed and constructed, or an existing plant controlled so that the dependence and values of factors producing this selectivity are reproduced in the plant.

Figure 1:
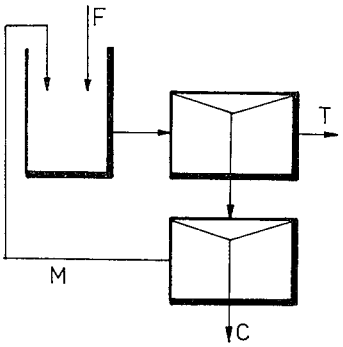
FIGS. 1–5 are flow sheets of different continuous flotation circuits, each comprising one conditioner and 2 to 4 flotation cells. In each figure F = feed, T = tailing (waste), C = concentrate and M = middling.

The distribution of the mineral flow in the flotation cell into waste flow and concentrate flow can be presented for each mineral type in terms of its flotation rate coefficient. For instance, in the circuits of FIGS. 1 and 5 the following distributions are obtained, wherein F = input flow of the mineral type, $F^1$ = flow of the concentrate, $F^2$ = flow of the middlings and $F^3$ = flow of the tailings and, in case of FIG. 1, $\tau_1$ and $\tau_2$ are the hydraulic time constants of the first and the second cell, respectively, and, in case of FIG. 5, $\tau_1$ is the hydraulic time constant in each one of the cells.

$$f_1 = F^1/F \quad f_2 = F^2/F \quad f_3 = F^3/F$$

$$1.\ \frac{k^2\tau_1\tau_2}{(1+k\tau_1)(1+k\tau_2)} \quad \frac{k\tau_1}{(1+k\tau_1)(1+k\tau_2)} \quad \frac{1}{1+k\tau_1} \tag{3}$$

$$5.\ \frac{k\tau_1}{1+k\tau_1}\left(1+\frac{1}{1+k\tau_1}\right)\frac{k\tau_1}{(1+k\tau_1)^3}\left(1+\frac{1}{1+k\tau_1}\right)\frac{1}{(1+k\tau_1)^4} \tag{4}$$

THE DETAILED DESCRIPTION

The method to be described first comprises the determination in the laboratory of certain basic quantities which are relevant in flotation technology. In this connection the dependence of said quantities on the inherent characteristics of ore minerals and on the controlling or influence variables occurring in industrial practice are also determined. Next, the method comprises for full scale continuous flow apparatus the dependence of conditioning and flotation on said basic variables and on their values in an industrial environment, and the determination of the respective dependences. This results in a mathematical model, normally presented in numerical form, of the flotation and conditioning system; when this model is used, the operation of the variable circuits is simulated and in this manner that particular design of the circuit and those values of the variables to be controlled are found which lead to the best result in view of economical, environment and other factors and of other designing criteria. The resulting design and values of the variables are then implemented physically in the industrial flotation plant to be constructed or controlled.

In order to determine the flotation rate coefficient k in the laboratory, a method previously known in itself is applied, in which the flotation of the interesting mineral, that is the amount made flotation of the interesting mineral, that is the amount made floating in unit time under the selected standard conditions, as a function of time from the start of flotation, is determined. The results may correspondingly be unambiguously stated as the concentration or amount of material still left in the cell at any given time. Since the coefficient k depends on the grain type, the determination is carried out separately for each size class that is of interest. It is an essential feature of the new method that the degree of adsorption of the collecting agent Γ is also known for the grain type in question under the floating conditions, as will be set forth in the following.

The degree of adsorption Γ can be determined, and the desired degree of adsorption may be produced in laboratory conditions by the new conditioning method. This implies that, to begin with, separately for each mineral type to be adsorbed the relationship between the growth of the mineral collecting agent coat and the decrease of the collecting agent concentration in the liquid phase is determined. The best accuracy of determination is achieved when only one adsorbing mineral type is present. This is achieved by selecting an ore sample wherein the mineral in question is present in as pure state as possible, merely accompanied by gang minerals which present little adsorption of the collecting agent used in the tests. In the separation such methods may be used as aid which have no essential influence on the flotation technology quality of the surface of the final mineral grains. A mineral type specified also as regards grain size is produced by comminution and screening. The presence of mixed grains is established, as required, e.g. by microscopy. The method is presented in the following as concerning pure grain types. The effect of mixed grains is separately estimated, or corresponding tests are carried out with them insofar as they can be separated from the pure ground grains.

Each grain type which is of interest is conditioned in a laboratory conditioner, in which capacity it is well to use a laboratory type flotation cell, the grains being dept in an aqueous suspension of which the initial concentration of collecting agent is known. The other parameters too, such as pH, initial concentration of the moderating agent, etc. are given the desired values in connection with the conditioning and, usually, prior to the addition of collecting agent. After conditioning has been in progress long enough to attain equilibrium, the ultimate concentration of the collecting agent in the liquid phase is determined. It has been found that unless the collecting agent is used in very great excess, but its quantity still surpasses that consistent with saturation of the mineral surface, then the quantity of collector in the solution will decrease only by the amount consistent with such saturation, which is considered in the following to correspond to the coating of the mineral surface with a monomolecular collector coat. When thus the collector quantity and concentration consistent with such a coat is known, it is possible in practice to produce any value of Γ in the range from 0 to 1 by using the corresponding fraction of the collecting agent quantity corresponding to the monomolecular coating. It has been found that normal industrial collecting agents are strongly adsorbed and the collector equilibrium concentration in the liquid phase is virtually zero unless overdosage is applied. In the determination of collector concentration on the side of requisite filtering a determining method based on the adsorption of ultraviolet light, or another suitable method, is used as required. The k(Γ) relationship can be determined by floating in the manner already described, mineral batches presenting different degrees of adsorption.

It is important in view of technical conditioning, also to know the value of the coefficient of adsorption X for each mineral type. In order to achieve this, laboratory tests are carried out using each mineral type separately, all the other adsorbing types being removed as completely as possible. The method implies that after the conditioning has started, that is after addition of the conditioning agent to the mineral suspension in the laboratory conditioner in operation, liquid samples are taken therefrom at known times and with appropriately short intervals. The liquid samples are separated from the mineral by filtering at the time of sampling or immediately after. The samples are analysed for the concentration of residual collecting agent.

In the analysis of the time dependence of the concentration that has been measured, equation (2) is utilized. $C_x$ and Γ are interconnected by the relationship (5).

$$C_x(t) = C_x(t = 0) - \Gamma C_{x\,sat} \tag{5}$$

$C_{xsat}$ = collector concentration (differential concentration) in the solution consistent with formation of full monomolecular coat.

The equations (2,5) are easy to solve even in closed form, and the result thus obtained is the dependence of Γ, or more practically of $C_x$, on the conditioning time. By experimental fitting of the concentration function experimentally obtained with this analytical function by the method of least squares, the value of X can be determined. It is also possible to show that a simple function of concentration gives a straight line on a semilogarithmic chart, and the fitting of the concentration function for simple determination of X may be based hereon.

When the adsorption and flotation properties of minerals are determined, it is expedient to combine in a suitable manner the experimental methods presented above. If for instance a mineral batch is conditioned for which first the value of X is determined in the manner described and this conditioning is continued long enough, the equilibrium value of Γ will be attained and the experiment may be immediately continued as a flotation experiment for the determination of k, by connecting the flotation air flow to the flotation cell which initially served as a conditioner. However, X need not be determined several times for one single mineral type; the greater part of the experiments may therefore be reserved for the attainment of a suitable Γ as ultimate value, with immediately following flotation experiment for the determination of k. The test series are separately performed with each grain size class of the mineral. If it is necessary to determine the dependence of the conditioning and flotation on pH, modifying agent, other collecting agents simultaneously employed, etc., these are given appropriate values in each instance by means of suitable addition of chemicals, and the requisite conditioning and flotation test are then carried out. In the case of a complex ore the aim is to isolate at least the most important adsorptive and floatable mineral in as pure state as possible and to perform in particular the determination of X separately for each mineral.

When a mineral suspension is conditioned in an industrial type continuous flow conditioner, determination of Γ is not possible, nor is that of X for the different grain types. It is even less possible to consider its determination in a continuous flow conditioner at the planning stage when rather often there is no possibility whatsoever to undertake experiments on an industrial scale. Particularly as regards X, reliance has then to be placed on the results of laboratory tests. Since in addition to adsorption only mixing takes place in the conditioner, the values found in laboratory tests are rather well appropriate to be used as designing basis for the industrial conditioning. If required, the values may be corrected by using a coefficient having a value which depends on the strength of mixing. It is essential that the differences between the X coefficients of different minerals are manifested with the same direction of effect in both environments. A clear idea is thus obtained by means of designing based on laboratory values, of the mutual separation of the minerals even if there should be a systematic deviation in the absolute degree of adsorption.

It was already observed that for a continuous flow conditioner in the general case no exact mathematical model can be presented which would be amenable to practical solution. For this reason the following approximative method, for instance, is used to determine the degree of adsorption. The conditioner is here understood to be generally an apparatus wherein the greater part of collector adsorption takes place. Depending on the points where chemical is supplied, for instance an industrial classifier may operate as a conditioner as meant here.

Figure 6:
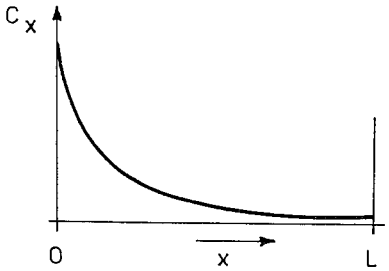
FIG. 6 shows the equilibrium concentration of the collecting agent in the liquid phase of a conditioner, as a function of the axial position coordinate.

When the conditioner comprised in the circuit under investigation, or otherwise a typical industrial conditioner, operates under conditions consistent with steady state service, the concentration $C_x(x)$ of free collector is measured as a function of the conditioner's axial coordinate in the main direction of flow, whereby for instance the function displayed in FIG. 6 is obtained. The distribution of time of residence p(t) of the mineral grains in the conditioner is separately determined e.g. by a tracer test. Each grain is considered to pass through the conditioner with a constant velocity, whereby the time and position coordinates are directly proportional.

$$\theta = \frac{x}{L} t \quad 0 \leqq \theta \leqq t \quad 0 \leqq x \leqq L \tag{6}$$

Applying equation (2), we now find for a particle in the conditioner:

$$\frac{d\Gamma}{d\theta} = X(1 - \Gamma)G_x(\theta) \quad 0 \leqq \theta \leqq t \tag{7}$$

The equation is now integrated between 0 and t, which is usually done numerically, whereby one finds the degree of adsorption Γ(t) of a particle having the residence time t. When now the distribution function p(t) and the function Γ(t) both are known, the distribution p(Γ) of the degree of adsorption can be calculated in well-known manner. This calculation is separately made for each grain type; this is purely a calculation operation because $C_x(x)$ is the same function in every instance, and p(t) is normally nearly the same for all grain types. If required, p(t) may be separately determined for each grain size class.

In the prior art it has only been possible to perform with success a similar calculation in a simple limiting case (Niemi, Loc. Cit., p. 35). In that connection the conditioner was assumed to be an ideal mixer, whereby $C_x$ reduces to a constant and p(t) is a simple exponential function.

The distribution of the mineral in the flotation cells depends in a manner known and previously described, on the flotation rate coefficient k. As now the k(Γ) relationship has been determined by laboratory tests for each grain type, the flotation rate coefficient in expressions corresponding to (3,4) may be replaced by this function or by the corresponding degree of adsorption function. The flotation rate coefficient of a given grain type in an industrial cell and its dependence on the degree of adsorption differ usually somewhat from those measured in the laboratory. In this presentation the coefficient determined in the laboratory under standard conditions and the dependence are considered to be grain-individual standard quantities, on which the coefficient and the dependence of another similar grain in the conditions of the fully specified point of operation of the industrial cell are unambiguosly dependent. Different operating points differ with regard to cell-individual factors, such as impeller speed, air flow, frother concentration, etc., on which the coefficient depends in addition. It is essential in view of selectivity that the differences in flotation rate coefficient and the changes in the function describing the dependence on the coefficient determined in laboratory conditions of that coefficient which is realized in the industrial cell and furthermore its dependence on the degree of adsorption Γ of the grain, are manifested as effects in the same direction with different minerals and grain types in the particular operating conditions. The person responsible for design, construction or control of a flotation plant may thus choose those values which are the most favourable ones in view of the design criteria and implement them in full scale industrial practice by assigning values consistent therewith to the above-mentioned, and other variables controlling the operation of the cell, whereby the said quantities and rate coefficients may have different values in different cells.

The primary feed flow of the individual mineral type to the conditioning step $F_o$ presents, on departing from this stage, the distribution with regard to the degree of absorption Γ:

$$dF_o = F_o p_o(\Gamma)\, d\Gamma \tag{8}$$

The distribution of the mineral type in the flotation circuit is found with the aid of known functions, e.g. (3,4). For the flow to the concentrate, for instance, we find, performing at the same time the above-presented substitution of variable:

$$dF^1 = F_o P_o(\Gamma) f_1(\Gamma) d\Gamma \tag{9}$$

By making the respective distribution calculations separately for each grain type and integrating over the different types of one mineral, that is by adding the results in the case of each mineral, one finds the distribution of different mineral among concentrate, tailings and potential middlings, and their separability may be compared. The separability may also be compared with regard to grain types, and it is possible to study the influence thereon of the different process parameters, variable values, grain size distributions, etc. Since the expressions (3,4) are comparatively simple to formulate even in the case of complex flotation circuits, it is furthermore easy to institute comparisons between different modes of connection.

The requisite calculations are most conveniently carried out with the aid of a digital, or if desired an analog, computer. As has been presented, the programming may be linear, and simulation in view of finding the best alternative designs by varying different parameters and variables as well as functional relationships and connections is a procedure commonly applied in automatic data processing.

Insofar as there occurs closed circulation, or returning, of material to the preflotation conditioner, this has to be taken into account. The corresponding procedure is described in the following only with regard to a system wherein the conditioner in question operates like an ideal mixer as regards its flow characteristics. In systems comprising recirculation of materials the conditioners are mostly of this type. Thus the input of the conditioner consists of the non-conditioned primary feed and of the intermediate (M or F in FIGS. 1-5), and its output flow is at the same time the input of the flotation step. From the known exponential residence time distribution of the ideal mixer the distribution (10) is found for the grain type fed from the conditioner into the flotation circuit. Since in this case the collector concentration is constant, the degree of adsorption $\Gamma$ depends unambiguously on the conditioning time t, $\Gamma = \Gamma(t)$, and the residence time t in the conditioner may be selected as an independent variable.

$$dF_o = F_o p_o(t)dt = F_o \frac{1}{\tau} e^{-\frac{t}{\tau}} dt \tag{10}$$

Since furthermore the flotation rate coefficient is unambiguously dependent on the degree of adsorption, $k = k(\Gamma)$, and thus further on the conditioning time $k = k[\Gamma(t)] = k(t)$, we find for the grain type returning to the conditioner:

$$dF_1 = F_o p_o(t) f_2(t)dt \tag{11}$$

Here $f_2$ is the fraction of the feed which returns from the flotation circuit to the conditioner. It is an unambiguous function of k and, further on, of t; for two simple example circuits $f_2$ is shown by expressions in (3) and (4). The following derivation resulting in equation (15) is valid for arbitrary forms of the functions $f_2(k)$ or $f_2(t)$ and of the function K(t).

The material that has passed twice through the conditioner is distributed with regard to the residence times at both passes.

$$d(dF_1) = F_o p_o(t_1) f_2(t_1) p_o(t_2) dt_1 dt_2 \tag{12}$$

When now the total residence time is chosen as variable and all the elements of the grain type are integrated (added) which have spent the same total time in the conditioner while passing twice, we find equation (13). In other words, the assumption is made that the grain returning to the conditioner has the same collector coating which it had when it left the conditioner on the preceding cycle, and that its conditioning continues in the same manner.

$$dF_1 = F_o \frac{1}{\tau^2} e^{-\frac{t}{\tau}} \int_o^t f_2(t_1)dt_1 dt = F_o p_1(t)dt \tag{13}$$

By continuing thus, we find for the quantitative flow rate of the grain type that has passed through the conditioner n times and is leaving it to go to the flotation circuit:

$$dF_{n-1} = F_o p_{n-1}(t)dt = -F_o \frac{1}{\tau^n} e^{-\frac{t}{\tau}} \int_o^t f_2(t_{n-1}) \int_o^{t_{n-1}} f_2(t_{n-2}) \int_o^{t_{n-2}} \cdots \int_o^{t_2} f_2(t_1)dt_1 \ldots dt_{n-2}dt_{n-1}dt \tag{14}$$

The total distribution of the grain type in the flow from the conditioner to the flotation circuit is found by adding together the expressions consistent with (14) corresponding to all values of n. It can be shown that the resulting sum expression may be further converted into the fairly simple form (15).

$$DF_f = \sum_{j=o}^{\infty} dF_j = F_o \sum_{j=o}^{\infty} p_j(t)dt = F_o \frac{1}{\tau} \exp\left\{\frac{1}{\tau}\left[\int_o^t f_2(t')dt' - t\right]\right\}dt \tag{15}$$

In the result (15) one integration replaces the consecutive integrations of equation (14), which are infinite in number in principle, whereby it renders the making of exact calculations feasible in principle, and even fast and easy. The total grain type flow into concentrates or tailings is found by multiplying (15) by $f_1$ or $f_3$, respectively, and by integrating over the time variable t (from 0 to infinite). If the integration is furthermore performed over all grain types of one mineral, then the distribution of the whole mineral is clarified and one may further proceed to compare the separation of different minerals, using various alternative connections and relationships as well as different parameter and variable values.

The open or closed flotation circuit to which the method is applied may generally comprise flotation and other apparatus of various types, because in general expressions corresponding to (3,4) can be derived for them. It is further possible also to consider circuits comprising closed material circulation and possibly a plurality of conditioners, because each one of them can be normally considered, at least by the previously presented approximate mode. The same is also true for the inclusion in the consideration of such conditioning which takes place before the material arrives in the closed circuit.

The method combines experimental determinations with simulation by computer and with full scale plant practice. The computer calculations, which are based on the experimentally acquired fundamental information, are clear-cut and fast to carry out. The method of design, construction and control is based on the inherent chararcteristics of the minerals and on the effects that can be exerted thereon by physical and chemical means. The parameters and variables used describe the basic properties of the mineral grains, which are the same in principle both in laboratory and in industrial scale apparatus. The reproduction of the results of laboratory determinations and computations, in the industrial plant, is therefore straightforward. By the method a high number of various circuit arrangements are analyzed within a short time, and thereby the dependence of results of flotation on various factors is disclosed, not only on factors, in the conditioning/flotation system but also outside it, like on the degree of grinding and the distribution of grain size resulting from comminution. Therefore use may also be derived from the results obtainable by the method in the designing of the comminution step. Since for determination of the values of the requisite fundamental parameters a small amount of material suffices, which may be obtained even from rock drill cores, the method offers better chances than before for the assessment of the concentration results to be expected, at an early stage, and thereby affords a more precise basis for decisions concerning the commencement of contemplated mining activities. Thanks to its speed and quantitative character, the method is particularly appropriate in such design and control which aims at a controlled selectivity.

The following example illustrates the invention by describing in detail one preferred embodiment of the method of constructing a continuously operable flotation concentration plant.

EXAMPLE

An ore containing chalcopyrite but very little of other sulphide minerals was pulverized and the different grain size classes were separated by sieving. Material belonging to one class, namely 100–150 mesh, was taken in amount of 0.6 kg, suspended with agitation in 2 kg of water in a laboratory type froth flotation cell and maintained in suspension with the aid of the cell's propeller. pH was adjusted to 11.5 with $Ca(OH)_2$. Frothing agent Dowfroth (Trademark) was added in a quantity consistent with concentration 10 mg/l.

Sodium xanthate was used as the conditioning chemical and added to the suspension in a quantity corresponding to concentration 10 mg/l. Small samples were taken from the suspension at 10 sec. intervals onto a suction filter during one minute.

The filtered samples were analysed by spectrophotometer Beckman 25, using 3000 Å wavelength, which is the location of the adsorption maximum of the xanthate in question. From the results the xanthate concentration ($C_x$) was found to decrease as a function of time, approaching the value $C_{xoo}$ = 7.8 mg/l, which was considered to correspond to adsorption equilibrium at $\Gamma = 1$.

The experiment was immediately continued as a froth flotation test by opening the air valve of the cell; the preregulated air flow was 14.1 l/min. The produced froth was collected in a tray, which was changed to begin with at 15-second, and later at 30-second and 60-second intervals.

The samples were filtered, dried and weighed. Their copper content, as well as that of the original material, was determined after dissolving, by atomic adsorption spectrometer Perkin-Elmer 303. From the results the quantity of copper, and further of calcopyrite, in the original samples and in the suspension contained in the cell at the end of each sampling period was calculated. By fitting the function obtained by integration of the equation (1), to the results of the experiment by the known method (Imaizumi & Inoue, Loc. Cit.), the value of 0.75 $min^{-1}$ was found for the flotation rate coefficient k.

The experiment was repeated three times using low values of the initial concentration of the conditioning chemical, which were consistent with adsorption grades $\Gamma$ = 0.25, 0.50, 0.75. A graphical presentation was prepared of the function $k(\Gamma)$ in the form of a line passing through the four points found and through the origin, and the corresponding algebraic representation was written.

The test series was repeated with materials of the sieve classes 150–200 mesh and 200–270 mesh, whereby for these the respective functions $k(\Gamma)$ were found. The value of the adsorption rate coefficient was not determined in all experiments after it had been found that its values obtained in different experiments were of the same order of magnitude. Its average value was found to be X = 14 l/gs.

In order to further illustrate the method, the functions obtained were applied in simulating the operation of simple continuous flow flotation circuits. The conditioning chemical concentration in the conditioners of FIGS. 1–5 was assumend to be $C_x$ = 10 mg/l. The hydraulic time constant of the conditioner (volume divided by the volumetric flow) was chosen to be 8 min. and the time constant of all flotation cells, $\tau_1 = \tau_2 = 5$ min.

The expression $f_2$ describing the step of flotation was substituted in each case in equation (15), whereby the distribution of the individual grain type with regard to residence time t in the conditioner was obtained. For the circuits in FIGS. 1 and 5 the detailed expressions of $f_2$ were shown in (3) and (4), and similar expressions were derived for the other circuits. The obtained function (15) was multiplied by the corresponding function $f_1(t)$ and integrated over the residence interval $0 \leqq t \leqq 60$ min., whereby the proportion of the grain type was found which ended up in the concentrate. Similarly, the function was multiplied by the expression $f_3(t)$ and integrated, in order to find the proportion going to the tailings. The adjacent table shows that the predominant part of the material that is floated departs from each circuit within 60 min. While the qualitative distributions are shown by the table, it reflects also the qualitative differences between different circuit arrangements and different grain types. It is seen e.g. that in the circuit of FIG. 1, where the grain may end up directly in the tailing already from the first cell, the yield of mineral is poorer than in the other circuits. It is also seen more generally that the more cells the particle has to pass in order to end up in the tailing, the higher is the yield in the concentrate, in the studied cases. If compared with the circuit of FIG. 3, the circuit of FIG. 2 gives a higher yield, because in the former case the particles which are floated by the first cell have still a possibility of ending up in the tailing.

The separation of two floatable minerals was investigated by carrying out equivalent experimental determinations with pyrrhotite. In the simulation the model of an industrial flotation circuit was now employed, and the results obtained with different alternative connections were compared in order to establish the alternative yielding the best separation.

Table Cumulative percentages of the feed found in the concentrate and in the tailing after 60 min.

Figure 2:
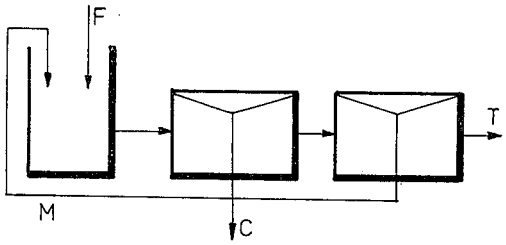

| Grain size class Mesh | Circuit | Concentrate % | Tailings % | Total % |
|---|---|---|---|---|
| −100/+150 | FIG. 1 | 74.38 | 25.43 | 99.81 |

-continued

Figure 4:
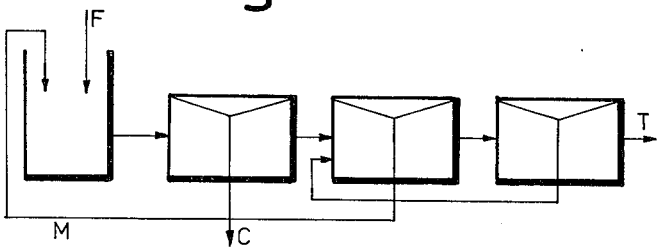
Figure 3:
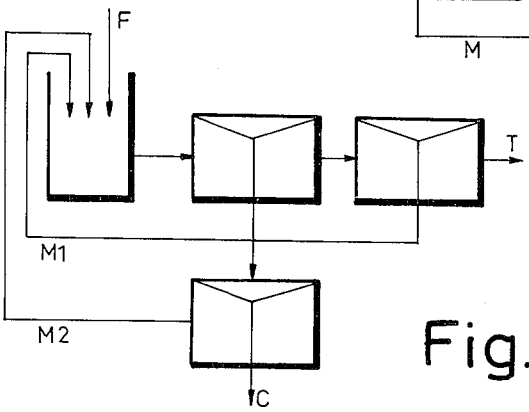
Figure 5:
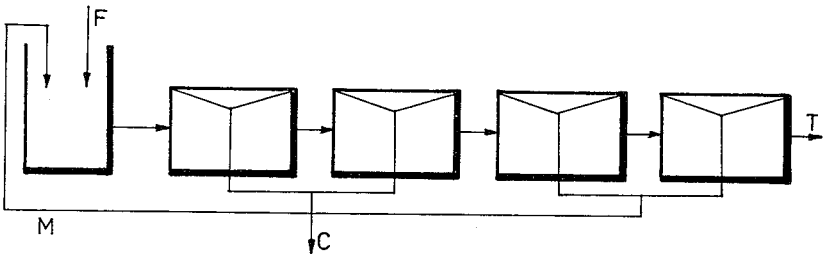

| Grain size class Mesh | Circuit | Concentrate % | Tailings % | Total % |
|---|---|---|---|---|
| | FIG. 2 | 94.36 | 5.45 | 99.81 |
| | FIG. 3 | 92.60 | 6.74 | 99.34 |
| | FIG. 4 | 98.26 | 1.50 | 99.76 |
| | FIG. 5 | 99.67 | 0.26 | 99.93 |
| −150/+200 | FIG. 1 | 87.78 | 12.11 | 99.99 |
| | FIG. 2 | 98.49 | 1.40 | 99.89 |
| | FIG. 3 | 98.22 | 1.55 | 99.77 |
| | FIG. 4 | 99.64 | 0.24 | 99.88 |
| | FIG. 5 | 99.88 | 0.06 | 99.94 |
| −200/+270 | FIG. 1 | 86.85 | 13.03 | 99.88 |
| | FIG. 2 | 98.31 | 1.57 | 99.88 |
| | FIG. 3 | 97.99 | 1.76 | 99.75 |
| | FIG. 4 | 99.62 | 0.25 | 99.87 |
| | FIG. 5 | 99.89 | 0.05 | 99.94 |

I claim:

1. A method of effecting flotation of mineral grains on a laboratory scale comprising conducting a mineral sample of uniform grain size and uniform mineral composition into water in a flotation cell, subjecting the mineral grains to conditioning by conducting a strongly adsorbable collecting agent into said water in an amount which is a fraction of the amount sufficient to create a monomolecular layer on the mineral grains, continuing the conditioning to allow the mineral grains to adsorb completely the collecting agent from the aqueous suspension so that the degree of adsorption attains a value corresponding to said fraction, subjecting the conditioned mineral grains to flotation by conducting air into the aqueous suspension, separating the floating mineral grains at time intervals during the flotation and determining the flotation rate coefficient by means of the separated quantities so that by varying the degree of adsorption in repeated treatments the dependence of the flotation rate coefficient on the degree of adsorption may be determined.

2. A method of constructing a continuously operable flotation concentration plant, which method includes the steps of:

(a) conducting a mineral sample of uniform grain size and uniform mineral composition into water in a flotation cell, subjecting the mineral grains to conditioning by conducting a strongly adsorbable collecting agent into said water in an amount which is a fraction of the amount sufficient to create a monomolecular layer on the mineral grains, continuing the conditioning to allow the mineral grains to adsorb completely the collecting agent from the aqueous suspension so that the degree of adsorption attains a value corresponding to said fraction, subjecting the conditioned mineral grains to flotation by conducting air into the aqueous suspension, separating the floating mineral grains at time intervals during the flotation and determining therefrom the flotation rate coefficient;

(b) repeating step (a) a plurality of times using a different degree of adsorption in each case thereby to determine the relationship between the degree of adsorption and the flotation rate coefficent, (c) repeating the combination of steps (a) and (b) for other grain sizes of said mineral composition that are present in the material to be handled in the concentration plant, (d) repeating the combination of steps (a), (b) and (c) for other mineral compositions present in the material to be handled in the concentration plant, (e) using the relationships between the degree of absorption and the flotation rate coefficient for different mineral compositions and for different grain sizes to determine, by means of a predetermined simulation procedure, the distribution of the material to be handled in a continuous flotation concentration process, and (f) constructing the concentration plant by providing the means for carrying out continuous distribution of the material into concentrates, wastes and middlings, wherein the composition of said fractions is in accordance with the distribution as determined in step (e).

3. A method according to claim 2 wherein, in one of the plurality of steps (a) that constitute the combination of steps (a) and (b), during the conditioning small quantities of liquid are sampled and the concentrations of the collecting agent in these samples are measured to provide an adsorption coefficient to be used in step (e).

4. A method of constructing a continuously operable flotation concentration plant, which method includes the steps of:

(a) conducting a mineral sample of uniform grain size and uniform mineral composition into water in a flotation cell, subjecting the mineral grains to conditioning by conducting a strongly adsorbable collecting agent into said water in an amount which is at least sufficient to create a monomolecular layer on the mineral grains, continuing the conditioning to allow a monomolecular layer to be formed and measuring the final concentration of the collecting agent thus letting the amount sufficient to create a monomolecular later to be exactly determined, (b) conducting a mineral sample similar to that in step (a) into water in said flotation cell, subjecting the mineral grains to conditioning by conducting a strongly adsorbable collecting agent into said water in an amount which is a fraction of the amount sufficient to create a monomolecular layer on the mineral grains, as determined by means of step (a), continuing the conditioning to allow the mineral grains to adsorb completely the collecting agent from the aqueous suspension so that the degree of adsorption attains a value corresponding to said fraction, subjecting the conditioned mineral grains to flotation by conducting air into the aqueous suspension, separating the floating mineral grains at time intervals during the flotation and determining therefrom the flotation rate coefficient;

(c) repeating step (b) a plurality of times using a different degree of adsorption in each case thereby to determine the relationship between the degree of adsorption and the flotation rate coefficent, (d) repeating the combination of steps (a), (b) and (c) for other grain sizes of said mineral composition that are present in the material to be handled in the concentration plant, (e) repeating the combination of steps (a), (b), (c) and (d) for other mineral compositions present in the material to be handled in the concentration plant, (f) using the relationships between the degree of adsorption and the flotation rate coefficient for different mineral compositions and for different grain sizes to determine, by means of a predetermined simulation procedure, the distribution of the material to be handled in a continuous flotation concentration process, and (g) constructing the concentration plant by providing the means for carrying out continuous distribution of the material into concentrates, wastes and middlings, wherein the composition of said fractions is in accordance with the distribution as determined in step (f).

5. A method according to claim 4, wherein, in one of the plurality of steps (b) that constitute the combination of steps (b) and (c), during the conditioning small quantities of liquid are sampled and the concentrations of the collecting agent in these samples are measured to provide an adsorption coefficient to be used in step (f).

6. A method of controlling a continuously operable flotation concentration plant, which method includes the steps of:

(a) conducting a mineral sample of uniform grain size and uniform mineral composition into water in a flotation cell, subjecting the mineral grains to conditioning by conducting a strongly adsorbable collecting agent into said water in an amount which is at least sufficient to create a monomolecular layer on the mineral grains, continuing the conditioning to allow a monomolecular layer to be formed and measuring the final concentration of the collecting agent thus letting the amount sufficient to create a monomolecular layer to be exactly determined, (b) conducting a mineral sample similar to that in step (a) into water in said flotation cell, subjecting the mineral grains to conditioning by conducting a strongly adsorbable collecting agent into said water in an amount which is a fraction of the amount sufficient to create a monomolecular layer on the mineral grains, as determined by means of step (a), continuing the conditioning to allow the mineral grains to adsorb completely the collecting agent from the aqueous suspension so that the degree of adsorption attains a value corresponding to said fraction, subjectint the conditioned mineral grains to flotation by conducting air into the aqueous suspension, separating the floating mineral grains at time intervals during the flotation and determining therefrom the flotation rate coefficient;

(c) repeating step (b) a plurality of times using a different degree of adsorption in each case thereby to determine the relationship between the degree of adsorption and the flotation rate coefficient (d) repeating the combination of steps (a), (b) and (c) for other grain sizes of said mineral composition that are present in the material to be handled in the concentration plant, (e) repeating the combination of steps (a), (b), (c) and (d) for other mineral compositions present in the material to be handled in the concentration plant, (f) using the relationships between the degree of adsorption and the flotation rate coefficient for different mineral compositions and for different grain sizes to determine, by means of a predetermined simulation procedure, the distribution of the material to be handled in a continuous flotation concentration process, and (g) controlling the concentration plant by adjusting the feeds of ore, water, conditioning chemicals and air to distribute the material continuously into concentrates, wastes and middlings, wherein the composition of said fractions is in accordance with the distribution as determined in step (f).

7. A method according to claim 6 wherein, in one of the plurality of steps (b) that constitute the combination of steps (b) and (c), during the conditioning small quantities of liquid are sampled and the concentrations of the collecting agent in these samples are measured to provide an adsorption coefficient to be used in step (f).

* * * * *